United States Patent [19]

Bourdois et al.

[11] 4,066,909

[45] Jan. 3, 1977

[54] CONTAINER FOR RADIOACTIVE OBJECTS

[75] Inventors: Claude Bourdois, Palaiseau; Charles Glachet, Vendome; Paul Marchal, Gif-sur-Yvette; Jean Vertut, Issy-les-Moulineaux, all of France

[73] Assignee: Commissariat a l'Energie Atomique, Paris, France

[21] Appl. No.: 728,841

[22] Filed: Oct. 1, 1976

[30] Foreign Application Priority Data

Oct. 3, 1975 France ..... 75.30442

[51] Int. Cl.[2] ..... G21F 5/02

[52] U.S. Cl. ..... 250/497; 250/493

[58] Field of Search ..... 250/497

[56] References Cited

U.S. PATENT DOCUMENTS 2,843,754 7/1958 Costello ..... 250/497

*Primary Examiner*—Harold A. Dixon

*Attorney, Agent, or Firm*—Cameron, Kerman, Sutton, Stowell & Stowell

[57] ABSTRACT

The container consists of a shielded body having an internal cavity and of a capsule which can be inserted into the cavity and is capable of sliding motion along the axis of this latter. The front face of the capsule is sealed by means of a removable door and the rear face is attached to an operating rod. The cavity is sealed beyond the front face of the capsule by means of a shielded element for positioning a cover opposite to the removable door of the capsule. The cover cooperates with means for permitting leak-tight coupling or uncoupling of the cover and the capsule by displacing these latter in relative motion.

14 Claims, 9 Drawing Figures

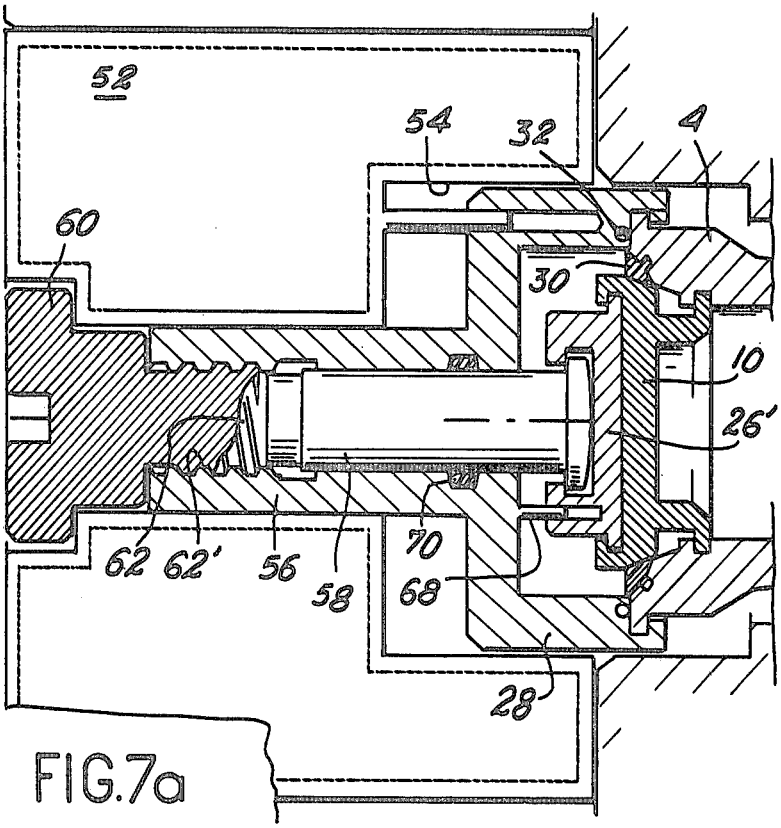
FIG.7a
FIG.7b
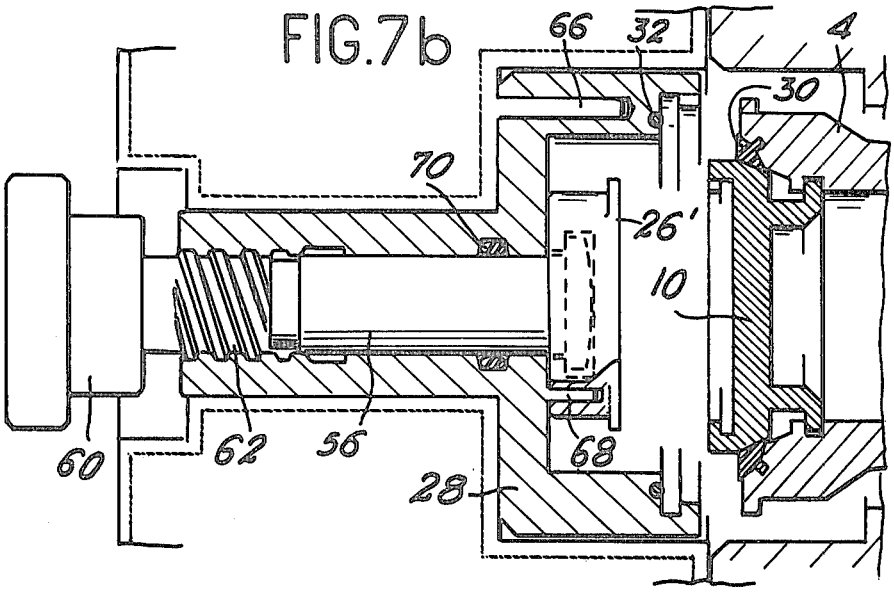

CONTAINER FOR RADIOACTIVE OBJECTS

This invention relates to a container which serves to transport radioactive objects and can be loaded or unloaded in a satisfactory manner both through the sealed wall of a hot cell and under water.

In more precise terms, the invention relates to a container of the type comprising a high-strength body of heavy material which is intended to absorb radiations and a containment capsule which is sealed-off by means of a removable door, said capsule being inserted in said body.

It is known that containers of this type are preferably loaded or unloaded by coupling with a hot cell, this coupling operation being carried out in such a manner as to prevent any contamination by interruption of leak-tightness while maintaining satisfactory protection against radiations.

On account of the known difficulties involved in preventing deposition of residual contamination on the external face of the capsule door at the time of the coupling operation mentioned above, it is found necessary to provide these containers with a secondary containment beyond that surface of the capsule which may be contaminated.

In the case of container designs of the prior art, however, this secondary containment is not guaranteed since it is obtained by associating a number of different closure elements with their shielded body on leak-tight manner.

Furthermore, the construction design of this type of containment is complex since these elements are located outside the container, are therefore unprotected and also require auxiliary devices for placing them in position.

It is also known that the above-mentioned containers of the type designed prior to the present invention do not lend themselves either readily or satisfactorily to underwater loading, on the one hand by reason of the need to employ auxiliary devices in order to open or close said capsule under water and on the other hand by reason of the fact that internal drying of the entire container cannot be carried out by means of simple operations.

The present invention is precisely directed to a container which makes it possible to overcome all the disadvantages mentioned in the foregoing. The container in accordance with the invention comprises in known manner on the one hand a shielded body provided with an internal cavity and on the other hand a capsule which can be inserted into said cavity, said capsule which is sealed on its front face by means of a removable door and the rear face of which is rigidly fixed to an operating rod being capable of sliding along the axis of said cavity through one of its extremities.

The invention is essentially distinguished by the fact that said cavity of the shielded body is sealed beyond the front face of said capsule by means of a shielded element for positioning opposite to the removable door of said capsule a cover which is capable of cooperating with corresponding means arranged within said capsule so as to permit either leak-tight coupling or uncoupling of the cover and the capsule as a result of relative movement of said cover and said capsule.

The container as characterized in the foregoing has the advantage of providing a secondary internal containment within said shielded body and therefore affording a high degree of reliability, said containment being also obtained in a simple manner when said shielded element seals-off said cavity after loading or unloading of said container.

In a first alternative embodiment of the container in accordance with the invention, said shielded element is constituted by a sliding door which can be displaced transversely with respect to said cavity, said door being provided on the one hand with an opening through which said capsule is permitted to pass and on the other hand with at least one receptacle fitted with a member which is capable of cooperating with corresponding means provided within said cover so as to ensure that the coupling of said member with said cover takes place at the same time as the uncoupling of said cover and said capsule and conversely as a result of relative movement of said capsule and said member.

When the container in accordance with the invention and fitted with a sliding door is loaded by coupling with a hot cell, it is thus possible to prevent any contamination of the capsule door from spreading within the cavity since the cover can be locked as soon as the sliding door moves said cover into position opposite to said cavity and seals-off this latter.

Moreover, in order to permit underwater loading of the container which is sealed-off by means of a sliding door of this type, it is only necessary to ensure that said member of at least one of said receptacles is capable of cooperating with corresponding means arranged in the door of said capsule in order to permit coupling of said member with said door as a result of relative movement of said member and said capsule.

In a second alternative embodiment of the invention, said shielded element is constituted by a shield plug which can be introduced axially into said cavity, said shield plug being intended to accommodate said cover.

In a preferred form of construction of the container in accordance with said second alternative embodiment, there is also housed within said shield plug a member which is associated with the cover by means for positioning said member with respect to said cover, said member being capable after suitable positioning with respect to said cover of cooperating with corresponding means arranged in the door of said capsule so as to make it possible by displacing said capsule and said shield plug in relative motion to couple said member with said door when said capsule and said cover are uncoupled and conversely.

Thus the container which is provided in accordance with the invention with a shield plug of this type can be loaded or unloaded under water in a simple manner since it is possible after releasing said cover from said capsule and after fixing said member on the capsule door to open said capsule under water simply by extracting the shield plug from the cavity or to close said capsule simply by introducing the shield plug into the cavity.

In another preferred form of construction of the container in accordance with the second alternative embodiment, said shield plug which can be introduced axially into said cavity is housed so as to permit transfer of said capsule within a shielded sliding door which can be made integral with said container, said door being capable of displacement transversely to said cavity and provided with at least two openings respectively which are capable either of retaining said shield plug or permitting transfer of said capsule.

Thus the container in accordance with the invention, the cavity of which is sealed-off at the time of transportation by means of an axial shield plug can nevertheless be loaded or unloaded by coupling with a hot cell since said sliding door which can be adapted to said container makes it possible to carry out with complete safety the shield plug handling operations which are necessary in order to effect the coupling.

It may also be noted that, in this form of construction, the container in accordance with the invention can be loaded without specially adapting a sliding door to said container since it is readily apparent that the door can constitute the sealing system for the shield wall of the hot cell with which said container is coupled.

Further characteristic features and advantages of the present invention will become more clearly apparent from the following description of different alternative embodiments of the container in accordance with the invention which are given by way of illustration but not in any limiting sense, reference being made to the accompanying drawings in which.

Figure 8:
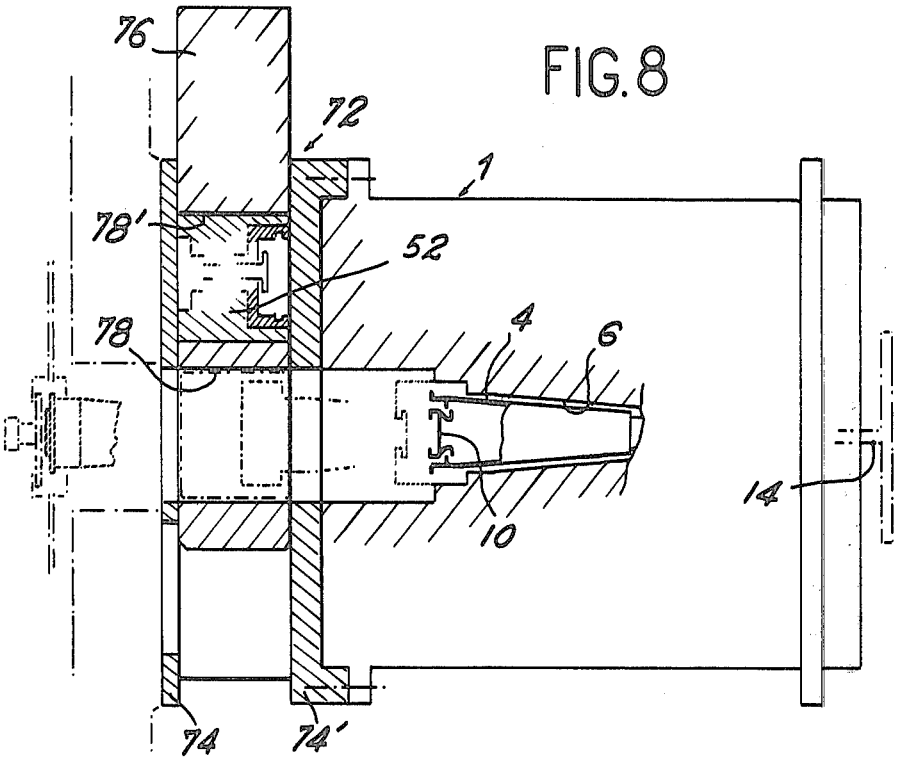
Figure 6:
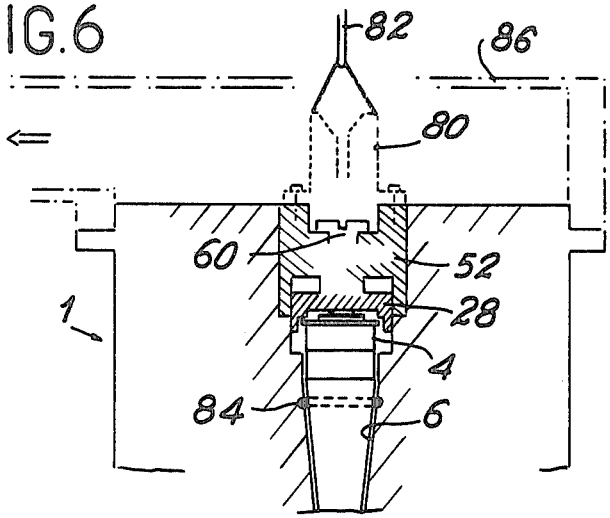
FIG. 6 is a horizontal sectional view of a second alternative embodiment of the container in accordance with the invention and provides a diagrammatic illustration of underwater loading of said container.

FIGS. *7a, 7b* illustrate the design of the axial shield plug which serves to seal-off the container of FIG. 6;

FIG. 8 is a diagrammatic view showing the loading of the container of FIG. 6 by coupling with a hot cell.

Figure 1:
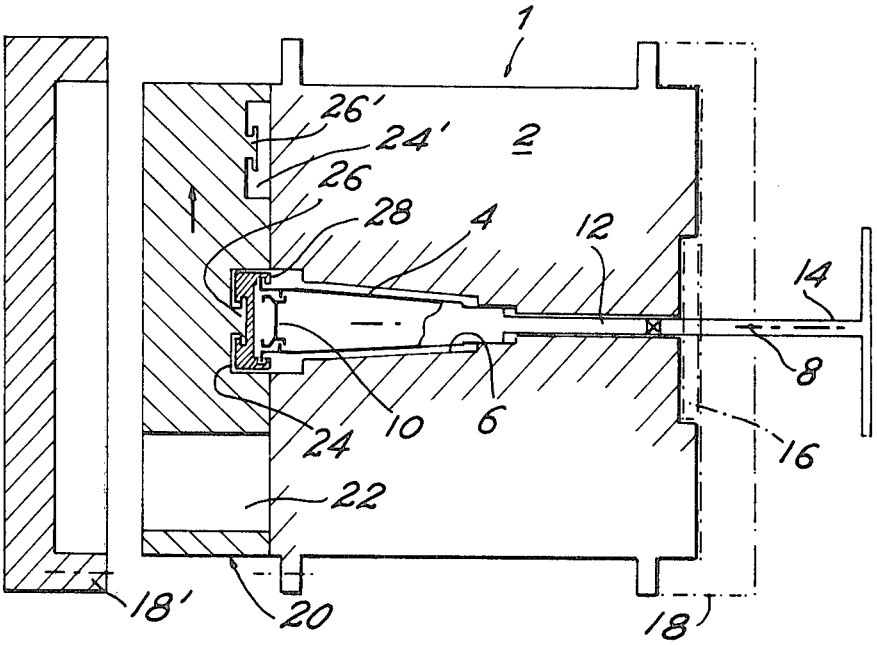
FIG. 1 is a horizontal sectional view of a first alternative embodiment of the container in accordance with the invention.

The container 1 in accordance with the invention as shown generally in the exploded view of FIG. 1 comprises a body 2 which is filled with lead so as to form the container shielding. A leakproof capsule 4 is housed within the cavity 6 which is of revolution with respect to the axis 8 and is formed within said body 2. Said capsule 4 is sealed-off in known manner by means of a removable door 10 which is coupled with this latter by means of a bayonet connection, leak-tightness of the connection being obtained by means of a seal carried by said capsule 4 and adapted to cooperate with said removable door 10.

it is apparent that the cavity 6 is adapted to the capsule 4 so that this latter is capable of moving along the axis 8 and one end of said cavity (namely the left end in FIG. 1) provides a passageway for said capsule. At the other end, said cavity permits the displacement of an operating rod 12, said operating rod being rigidly fixed to said capsule on the opposite face of this latter with respect to the face which is sealed-off by said door 10; said rod 12 can be connected to an operating handle 14.

For the purpose of transportation, said body 2 which is surrounded in an auxiliary manner by a heat-insulation layer is completed by shockproof plates such as the plate 16 and then closed by end-caps 18 and 18', said container being thus capable of affording resistance to impacts corresponding to a free drop and to a thermal shock corresponding to a fire.

Figure 2:
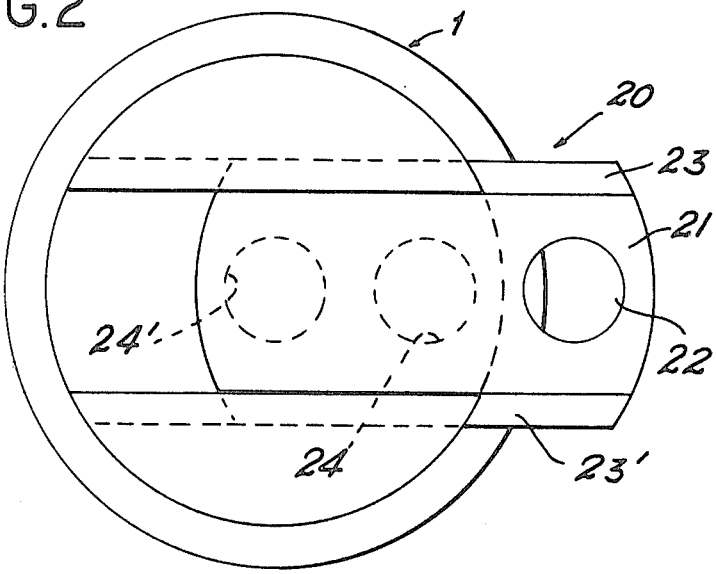
FIG. 2 is a front view of the sliding door for sealing-off the container which is shown diagrammatically in FIG. 1.

In accordance with a first alternative embodiment of the container in accordance with the invention, it is seen that the cavity 6 is sealed-off by means of a shielded sliding door 20 constituted as shown in FIG. 2 by a sliding block 21 inserted between two guides 23 and 23'. There are formed in said sliding block 21 on the one hand an opening 22 and on the other hand two recesses 24 and 24' which are fitted respectively with members 26 and 26'. As shown in FIG. 1 in the case of the member 26, said members 26 and 26' are capable of locking onto one of the faces of a cover 28. The other face of said cover is in turn capable of locking onto said capsule 4. These interlocks are obtained respectively in the case of opposite relative movements of said capsule 4 and said cover 28. Thus, in accordance with the essential feature of the invention, said shielded sliding door 20 which seals off the cavity 6 of the container 1 is capable of displacement in a transverse direction with respect to said cavity and thus positioning said cover 28 in oppositely facing relation to said capsule 4, whereupon said cover 28 can be locked onto said capsule 4 by means of the operating handle 14 after positioning of said cover, thus making it possible to achieve the desired secondary containment after loading of said capsule 4 without interrupting leak-tightness of the cavity 6.

At the present juncture, it may further be noted that the members 26 and 26' are also capable of locking onto said door 10 of the capsule 4 as a result of relative motion of said capsule and said members 26 and 26'.

In accordance with the invention, the various interlocks are preferably achieved by means of bayonet-type coupling systems which are judiciously designed in known manner and taking into account the bayonet system adopted for locking said removable door 10 onto the capsule 4. It is readily apparent that other types of locking systems can be contemplated such as for example ball systems actuated by relative translational motion of said capsule 4 and said cover 28.

Figure 3:
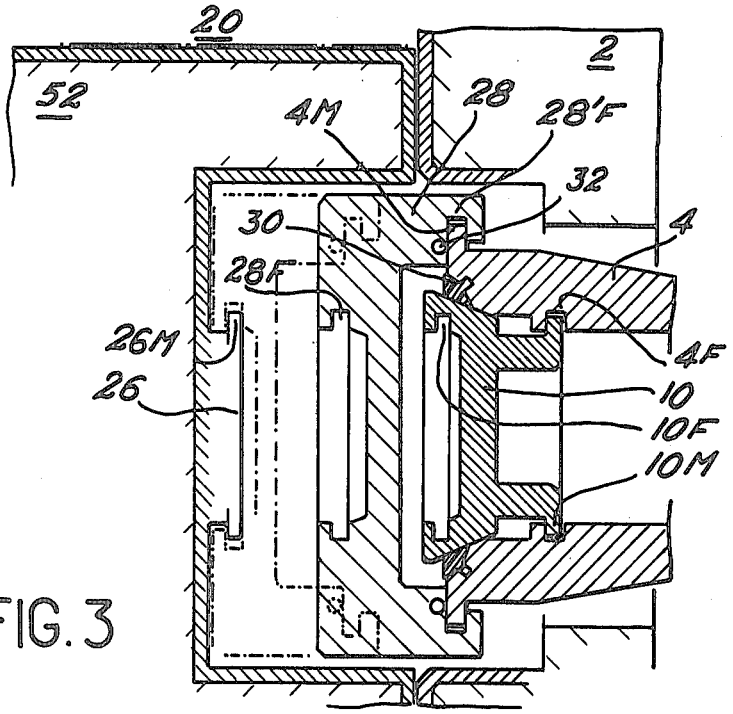
FIG. 3 shows the design of the interlocks between the difference elements of the container which are shown in FIG. 1 and intended to be coupled together.

The constructional design of the different bayonet-type coupling systems employed is illustrated diagrammatically in FIG. 3.

In this figure, the reference 1OM designates the male elements of the bayonet system which is capable of locking by right-hand rotation of the capsule 4 and makes it possible to lock the door 10 onto the capsule 4 by cooperating with the female elements 4F, leak-tightness of this locking system being achieved in known manner by means of the seal 30.

Moreover, it is apparent from this figure that the cover 28 carries on one of its faces the female elements 28F of a bayonet-type coupling system, the male elements 26M of which are carried by the member 26, this system being intended to be locked in position by left-hand rotational displacement of the capsule 4. Said cover 28 carries on its other face the female elements 28'F of a bayonet-type coupling system, the male elements 4M of which are carried by the capsule 4, this system being intended to be locked in position by right-hand rotational displacement of the capsule 4. It is noted in addition that the male elements 26M of the member 26 are also capable of cooperating with the female elements 10F provided in the door 20 of the capsule 4 in order to be locked in position by left-hand rotational displacement of the capsule 4.

Figure 4:
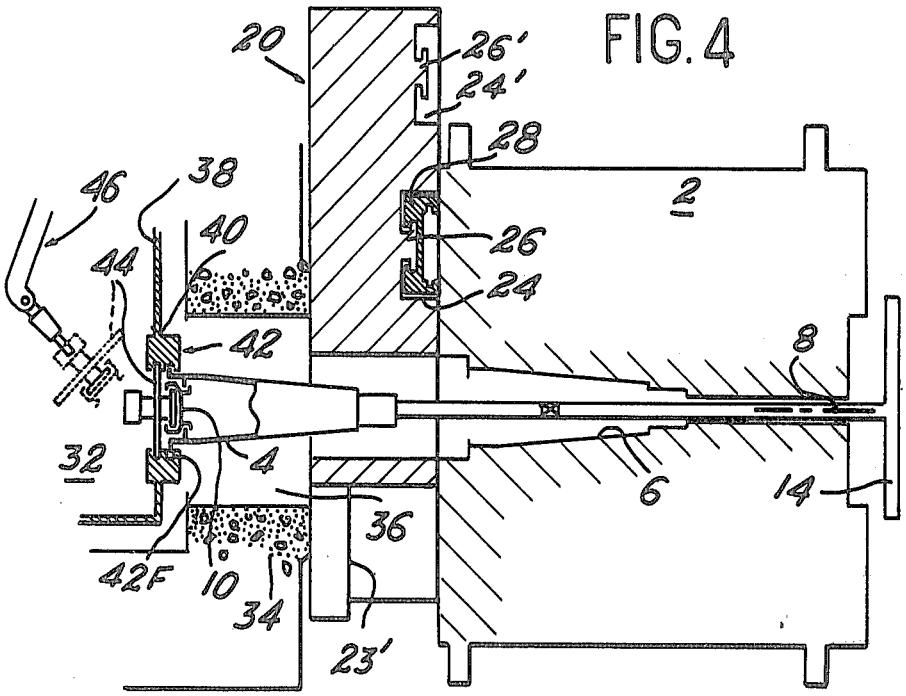
FIG. 4 is a diagrammatic view of the loading of the container of FIG. 1 by coupling with a hot cell.

The processes of loading of the container shown in FIG. 1 both through the wall of a hot cell and under water thus become apparent and result from all the arrangements described in the foregoing with reference to FIGS. 1 to 3. In FIG. 4, the container of FIG. 1 is shown diagrammatically during loading by coupling with a hot cell.

Before describing a complete loading operation of this type, it should be recalled that a hot cell 32 comprises a shield wall 34 in which is formed a bore 36 centered on a closure mechanism which is not shown in the drawings. A sealed enclosure 38 pierced by an opening 40 is placed within the interior of said hot cell 32. A coupling-flange 42 is mounted in leak-tight manner within said opening 40 and sealed by means of a door 44. The construction of said coupling-flange 42 and the design of the system adopted for locking said door 44 within said flange 42 make it possible in known manner to open said capsule 4 by removing said doors 44 and 10 as a single unit when said capsule is locked in position against said coupling-flange 42.

By referring to FIGS. 1 to 4, it is possible to follow the process of loading or unloading of the container 1 by coupling with said hot cell 32. After removal of the plates 16 and end-caps 18, the cover 28 is detached from the capsule 4 by means of the operating handle 14, thus locking said cover 28 against the member 26 of the recess 24. After displacing the door 20 in such a manner as to bring the opening 22 of this latter opposite to the cavity 6 of the container, the capsule 4 which is sealed-off by means of its door 10 is then pushed through the bore 36 of the hot-cell wall 34 by means of the operating handle 14 until said capsule 4 is in contact with the coupling-flange 42, the capsule door 10 being applied simultaneously in contact with the door 44 of the enclosure 38. The capsule 4 is then locked in position against said coupling-flange 42 while the door 10 is locked at the same time on the door 44 by means of the operating handle 14. By making use of the manipulator 46, it then becomes possible to open the capsule 4 by simultaneously releasing the doors 10 and 44 from the coupling-flange 42 and from the capsule 4 in order to carry out loading or unloading of this latter.

When loading has been completed, there are then performed the reverse operations which consist in closing the capsule, withdrawing said capsule into the cavity 6, displacement of the door 20 so as to bring the capsule 4 opposite to the cover 28 which can then be simultaneously released from the member 26 and again locked onto the capsule 4 by means of the operating handle 14.

It can be noted that by virtue of the two recesses 24 and 24' formed in said door 20, it is possible to replace a doubtful cover 28 by a decontaminated cover 28 while maintaining tightness of closure of the container cavity 6.

It is clearly apparent from the performance of the loading operations described in the foregoing that the cover 28 advantageously prevents residual contamination of the door 10 resulting from the different transfer operations mentioned above from spreading to the entire cavity.

It can readily be understood that additional safety of the capsule 4 combined in particular with the possibility of affording resistance to high pressures is also achieved by said cover 28 at the time of transportation by providing secondary leak-tightness which is added to that of the door 10.

The container of FIG. 1 can also be loaded under water. The process of underwater loading of said container can be followed by referring to FIGS. 1 to 3 and 5.

The process can be begun by carrying out above the water by means of the operating handle 14 and in respect of suitable position-locations of the sliding door 20, on the one hand the detachment of the cover 28 from the capsule 4 and locking of said cover 28 onto the member 26 and on the other hand the opening of the capsule door 10 which is locked onto the member 26.

Figure 5:
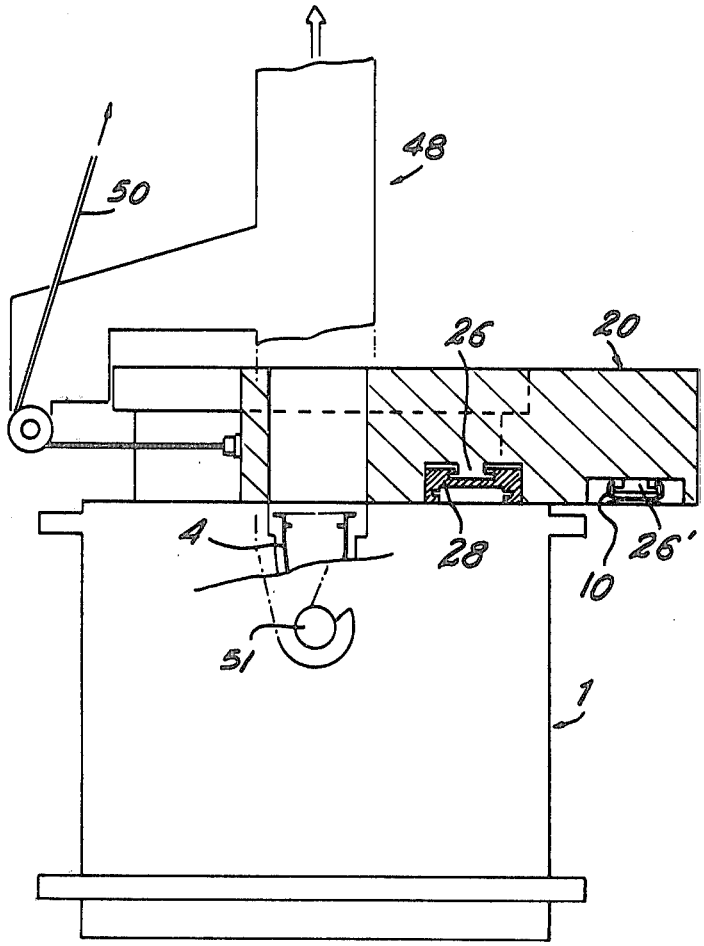
FIG. 5 is a diagrammatic view of underwater loading of the container of FIG. 1.

The container 1 is then moved downwards as shown in FIG. 5 with the opening of the door 20 located opposite to the cavity 6 by means of a rocker 48.

After placing the radioactive objects within the capsule 4 by means of a pole, the door 20 is displaced by means of a traction device 50 so as to close off the cavity 6 before withdrawing said container 1 from the water.

After pivotal displacement of the container about trunnions such as the trunnion 51 and drip-draining, closure of the capsule and locking of the cover 28 onto this latter are finally carried out, also by means of the operating handle 14 and in respect of suitable displacements of the door 20 while maintaining tight closure of the cavity 6.

FIG. 6 again shows in horizontal cross-section a second alternative embodiment of the container in accordance with the invention.

In this alternative embodiment, the cavity 6 of the container is sealed off axially by means of a shield plug 52 which can be housed for transportation purposes within the interior of said cavity 6 beyond the door 10 of the capsule 4.

Said shield plug will be described in detail with reference to FIGS. 7*a* and 7*b*. The different components of said shield plug which were already employed in the first alternative embodiment of the container for carrying out identical operations without being grouped together in a common shielded element will be designated by the same references as in FIGS. 1 and 2. It can be noted at the present juncture that the same constructional design is adopted for the different bayonet-type coupling systems which serve to lock the elements shown in FIG. 3.

It is thus apparent from FIGS. 7*a*, 7*b* that the shield plug 52 has a cavity 54 for accommodating the cover 28 which has an extension in the form of a sleeve 56. Said sleeve is provided axially with a central bore, a rod 58 which is coupled for translational motion with said member 26 being capable of displacement within said bore.

Said rod 58 has a threaded portion 62 which cooperates with the complementary threaded portion 62' provided in the wall of said sleeve 56 and thus makes it possible by means of the handle 60 to position said member 26 with respect to said cover 28.

Said cavity 54 of the shield plug which permits simultaneous translational displacement of the cover 28 and of the member 26 in order to permit withdrawal of these latter into the interior of said shield plug 52 (as shown in FIG. 7*b*) carries studs 66 for securing said cover 28 against rotational motion, said cover being also adapted to carry studs 68 for securing said member 26 against rotational motion.

O-ring seals such as the seal 70 interposed between the rod 58 and the sleeve 56 ensure leak-tightness of the cavity which is delimited by said cover 28 and the leak-tight door 10 of the capsule 4, the seal 32 being intended to ensure that locking of said cover 28 against the capsule 4 is achieved in leak-tight manner, said capsule 4 being also made leak-tight by means of the seal 30.

The mode of action of said shield plug 52 is as follows: it not only serves to couple the cover 28 with the capsule 4 by rotational displacement of said capsule but also serves to position the member 26 within the interior of the cover 28 for underwater loading in order to make it possible by rotational displacement of the capsule 4 to carry out both coupling of said cover with said capsule and disengagement of the member 26 from said door 10.

It is readily apparent that, in the case of loading by coupling with a hot cell, said member 26 is withdrawn into the cover since in this case said door 10 is opened by cooperating with the door 44 of the coupling-flange 42 of the enclosure 38.

As shown in FIG. 8, the container of FIG. 6 can be coupled with a sliding door 72 by suitable means of known type when it is necessary to couple the container with the hot cell 32.

It can be noted that the fact of being able to adapt said door 72 to said container for loading or unloading makes it possible to simplify the construction of the container while enhancing the reliability of this latter since closure of the container for transportation of this latter is carried out by means of a simple shield plug associated with end-caps 18 and 18'. At the time of loading, said door 72 makes it possible to remove and replace said shield plug without impairing the protection afforded by the shielding.

Said sliding door 72 comprises a sliding block 76 which is inserted between two guides 74, 74'. The sliding block 76 has two opengins 78 and 78' which can be brought into position in alternate sequence opposite to the cavity 6 of the container and consequently opposite to the bore 36 of the hot cell.

The process of loading of the container of FIG. 6 which is sealed-off by means of the shield plug 52 and to which the sliding door 72 has been adapted as shown diagrammatically in FIG. 8 will now be described.

By making use of the operating handle 14, the capsule 4 and the shield plug 52 which is locked onto this latter by means of the cover 28 are pushed simultaneously into one of the openings such as the opening 78 which is brought into position opposite to the cavity 6, the member 26 of said shield plug 52 being in a withdrawn position with respect to said cover 28.

When said shield plug 52 is housed within said door 70, said cover 28 is disengaged from the capsule 4 by means of the operating handle 14, said handle being again used to replace the capsule 4 which has been released from said shield plug 52 within the cavity 6, said shield plug being maintained stationary in rotational and translational motion within said opening 78. As can readily be understood, it is possible to carry out the disengagement of said cover from said capsule before pushing said shield plug into the opening 78 of the sliding door 72 by means of said capsule. The sliding block 76 is then displaced in order to bring the opening 78' opposite to said cavity 6 and in order to carry out the opening of the capsule 4 once this latter has been fixed on the coupling-flange 42, this procedure being identical with the sequence of operations described with reference to FIG. 4.

After re-positioning of the loaded capsule 4 within the cavity 6, it is possible in a reverse sequence of operations to seal off the cavity once again by means of the shield plug 52 and then to lock this latter onto the capsule 4.

It is worthy of note that, if the sliding block of a door as designated by the reference 72 is provided with a third opening 78" which is identical with those mentioned earlier, a shield plug 52 in which the cover 28 is contaminated can readily be replaced by another shield plug fitted with a cover 28 which is free of any contamination.

The container of FIG. 6 can easily be loaded or unloaded under water by virture of the design concept of the shield plug which makes it possible to open the door 10 of the capsule 4 under water simply by applying a tractive force on the shield plug. Thus in order to open the door 10 it is only necessary to make use of the operating handle 14 and to carry out above the water the disengagement of the cover 28 from the capsule 4 followed by coupling of the door 10 with the member 26, said member having been positioned in a suitable manner with respect to said cover 28.

In order to load the capsule 4, it is therefore only necessary to mount a lifting member 80 on the extremity of the shield plug 52, said member being attached to a cable 82, thus making it possible to open the capsule 4 under water by withdrawing the shield plug 52 from the cavity 6.

The container of FIG. 6 offers an advantage in that it can be dried in vacuo by means of simple auxiliary operations, thus removing any potential danger of contamination resulting from the presence of traces of water and especially from a pressure rise caused by vaporization of these latter.

By making use of an O-ring seal 84 which is fitted between the capsule 4 and the cavity 6, drying of the container can be contemplated by placing vacuum bell-housings such as the housing 86 at each end of the container in place of the end-caps 18 or 18' of FIG. 1.

When the different internal interlocks within the shield plug have not been effected and when the container is out of the water, it is thus possible to dry not only the interior of the capsule 4 but also the external face of the door 10 of this latter as well as the various mechanisms of the shield plug 52.

What we claim is:

1. A container for radioactive objects of the type comprising on the one hand a shielded body provided with an internal cavity and on the other hand a capsule which can be inserted into said cavity, said capsule which is sealed on its front face by means of a removable door and the rear face of which is rigidly fixed to an operating rod being capable of sliding along the axis of said cavity through one of its extremities, wherein said cavity is sealed beyond the front face of said capsule by means of a shielded element for positioning a cover opposite to the removable door of said capsule, said cover being capable of cooperating with corresponding means arranged within said capsule so as to permit either leak-tight coupling or uncoupling of the cover and the capsule as a result of relative movement of said cover and said capsule.

2. A container for radioactive objects in accordance with claim 1, wherein said shielded element is constituted by a sliding door which can be displaced transversely with respect to said cavity, said door being provided on the one hand with an opening through which said capsule is permitted to pass and on the other hand with at least one receptacle fitted with a member which is capable of cooperating with corresponding means provided within said cover so that as a result of relative motion of said capsule and said member, the coupling of said member with said cover can take place at the same time as the uncoupling of said cover and said capsule and conversely.

3. A container for radioactive objects according to claim 2, wherein said member of at least one of said receptacles is capable of cooperating with corresponding means arranged in the door of said capsule in order to permit coupling of said member with said door as a result of relative movement of said member and said capsule.

4. A container according to claim 3 wherein said member carries the male elements of a bayonet-type coupling system in which the female elements are provided within said door, said system being actuated by means of said operating rod.

5. A container according to claim 2, wherein said cover is provided on one face thereof with female elements of a first bayonet-type coupling system in which the male elements are carried by the front face of said capsule and on the other face thereof with the female elements of a second bayonet-type coupling system in which the male elements are carried by said member, said systems which are actuated by means of said operating rod being intended to be locked in respect of rotations of the capsule in opposite directions.

6. A container according to claim 1, wherein said shielded element is constituted by a shield plug which can be introduced axially into said cavity, said shield plug being intended to accommodate said cover.

7. A container according to claim 6, wherein said shield plug also houses a member which is capable of cooperating with corresponding means arranged in the door of said capsule so as to permit either coupling or uncoupling of said member and said door as a result of relative motion of said capsule and said member.

8. A container according to claim 7, wherein said member is associated with said cover in leak-tight manner by means for positioning said member with respect to said cover.

9. A container according to claim 7, wherein said cover and said member are capable of cooperating with corresponding means provided respectively within said capsule and within the door of said capsule in order to make it possible by displacing said capsule and said shield plug in relative motion to couple said cover with said capsule and to disengage said member from said door and conversely.

10. A container according to claim 8, wherein said shield plug can be housed so as to permit transfer of said capsule within a shielded sliding door which can be made integral with said container, said door being capable of displacement transversely with respect to said cavity and provided with at least two openings respectively which are capable either of retaining said shield plug or permitting transfer of said capsule.

11. A container according to claim 6, wherein said cover is provided with female elements of a bayonet-type coupling system in which the male elements are formed in the front face of said capsule, said system being actuated by means of said operating rod.

12. A container according to claim 1, wherein said cover carries an O-ring seal which is intended to cooperate with the front face of said capsule.

13. A container according to claim 9, wherein said cover is provided with female elements of a first bayonet-type coupling system in which the male elements are arranged in the front face of said capsule and wherein said member is provided with male elements of a second bayonet-type coupling system in which the female elements are arranged within the door of said capsule, said first and second systems being capable of locking in respect of movements of rotation of said capsule in opposite directions.

14. A container according to claim 7, wherein said member which is placed within the interior of said cover is coupled for translational motion with a threaded rod which can be displaced within a threaded sleeve formed in one piece with said cover in order to permit withdrawal of said member within said cover, said threaded extension being provided with an O-ring seal which is intended to cooperate with the wall of said sleeve.

* * * * *